US005169748A

United States Patent [19]

Apple et al.

[11] Patent Number: 5,169,748

[45] Date of Patent: Dec. 8, 1992

[54] UV SPECTRAL SENSITIZATION

[75] Inventors: Bernard A. Apple; Dietrich M. Fabricius; Joseph T. Guy, all of Hendersonville, N.C.

[73] Assignee: E. I. Du Pont de Nemours and Company, Wilmington, Del.

[21] Appl. No.: 788,000

[22] Filed: Nov. 7, 1991

[51] Int. Cl.[5] ..... G03C 1/06

[52] U.S. Cl. ..... 430/519; 430/139; 430/512; 430/567; 430/591; 430/966

[58] Field of Search ..... 430/512, 519, 139, 966, 430/567, 591

[56] References Cited

U.S. PATENT DOCUMENTS

| | | | |
|---|---|---|---|
| 4,024,069 | 5/1977 | Larach | 252/301.4 R |
| 4,225,653 | 9/1980 | Brixner | 428/690 |
| 4,246,485 | 1/1981 | Bossomaier | 252/301.4 R |
| 4,499,159 | 2/1985 | Brines et al. | 430/966 |
| 4,654,292 | 3/1987 | Oie et al. | 430/519 |
| 4,803,150 | 2/1989 | Dickerson et al. | 430/502 |
| 4,855,221 | 8/1989 | Factor et al. | 430/510 |
| 4,857,446 | 8/1989 | Diehl et al. | 430/510 |
| 4,900,652 | 2/1990 | Dickerson et al. | 430/507 |
| 4,940,654 | 7/1990 | Diehl et al. | 430/522 |
| 4,948,718 | 8/1990 | Factor et al. | 430/522 |
| 4,956,269 | 9/1990 | Ikeda et al. | 430/519 |

FOREIGN PATENT DOCUMENTS

| | | | |
|---|---|---|---|
| 3217383 | 11/1982 | Fed. Rep. of Germany | 430/591 |
| 0130285 | 3/1978 | German Democratic Rep. | 430/519 |

*Primary Examiner*—Charles L. Bowers, Jr.
*Assistant Examiner*—Thomas R. Neville

[57] ABSTRACT

A high resolution radiography system is presented utilizing a an intensifying screen incorporating a UV emitting phosphor. The photographic element exhibits enhanced sensitivity to the emission of the phosphor and further comprises at least one compound selected from the group comprising:

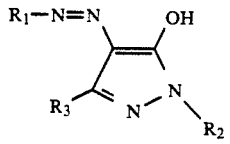

wherein $R_1$=substituted or unsubstituted aromatic ring; $R_2$=H, substituted or unsubstituted alkyl or substituted or unsubstituted aryl; $R_3$=an alkyl group, an aryl group, a COOR group wherein R is hydrogen, alkyl, aryl or an alkali metal cation, HNR4+ wherein $R_4$ is alkyl, substituted alkyl or alkyaryl.

8 Claims, No Drawings

UV SPECTRAL SENSITIZATION

FIELD OF INVENTION

This invention relates to the formation of a radiographic image. More specifically this invention relates to improvements in radiographic images formed with an intensifying screen. Still more specifically, this invention relates to improvements in sensitization of radiographic film for use with ultraviolet emitting intensifying screens.

BACKGROUND OF THE INVENTION

Radiography has been employed for many years as a medical diagnostic tool. A subject to be studied is placed between a x-ray radiation source and a detection system which typically includes an intensifying screen and a suitable photographic film. Intensifying screens have been employed in the art as a conversion device wherein x-ray radiation is converted to lower energy radiation such as visible radiation. Photographic film captures the image emitted by the intensifying screen and with subsequent development of the photographic film an image is generated which represents the variations in absorption of x-ray radiation as it passed through the subject.

Subject dosage and image quality are typically directly related for a given film/screen combination. There is an ongoing need to improve the image quality without increasing overall dosage for the subject. The dilemma has been advanced substantially by the use of both sensitizing and acutance dyes within the photographic element.

Sensitizing dyes are known in the art as a means for increasing the sensitivity of a silver halide emulsion to a specific band of wavelengths. A myriad of dyes have been presented to the art field as exemplified in *Research Disclosure*, No 308, December, 1989, Item 308119. In the field of radiography the spectral response of the silver halide emulsion preferably corresponds to the blue or green emission of the intensifying screen.

Acutance dyes have been presented in the art as a means of greatly improving image quality with subsequent minor increase in subject dose. This improved image quality is accomplished by decreasing the amount of light which scatters within the emulsion and more importantly by decreasing the amount of cross-over. Cross-over typically refers to screen emission which passes through, and is scattered by, the closest emulsion and the substrate and is subsequently captured by the emulsion on the opposite side of the support. The scattering of the emission as it passes through the support decreases the resolution of the resulting image. Pyrazolone dyes have shown great utility as crossover dyes as exemplified in U.S. Pat. Nos. 4,900,652; 4,948,718; 4,803,150; 4,855,221; 4,940,654 and 4,857,446.

In general, acutance or cross-over dyes compete with the silver halide grains for available emission from the intensifying screen resulting in a loss of overall photographic speed. The practitioner of the art is therefore forced to reach a balance between the photographic speed and resolution for a particular application.

Recent advances in the art include the use of intensifying screens which are comprised of phosphors which emit in the ultraviolet. One advantage of systems utilizing these phosphors is the inherent UV absorption of the photographic supports typically employed in the art. Cross-over is reduced substantially without the use of dyes and, in fact, one practicing the art would prefer to exclude acutance dyes in a system utilizing UV emitting screens. The resolution obtained with UV intensifying screens typically far exceeds the prior art techniques which employ acutance dyes and conventional intensifying screens. Further improvements with dyes are not expected to be warranted and, in fact, would be considered to be detrimental in light of the expected loss in system speed.

Contrary to these teachings from the art is a dye family which is well known in the art as an acutance dye, yet when utilized within the teachings provided herein has the unexpected property of increasing the system speed in the ultraviolet. Therefore, instead of decreasing system speed with a corresponding improved resolution as observed with blue and green emitting phosphors, films containing these dyes actually demonstrate an increased speed at a comparable resolution. An increase in speed is observed in spite of the lack of ultraviolet absorption by the dye.

SUMMARY OF THE INVENTION

Improved spectral sensitization of a silver halide photographic emulsion and other improvements are provided in a radiographic element comprising at least one x-ray intensifying screen in operative association with a photographic element;

wherein said x-ray intensifying screen comprises:

a support bearing a phosphor layer thereon; said phosphor layer comprises a binder with a phosphor dispersed therein, said phosphor further characterized by emission of light thereof wherein at least 80% of the light emitted upon exposure to x-ray radiation is between 300 and 390 nm, and said binder absorbs less than 10% of any light emitted from said phosphor;

wherein said photographic element comprises:

a substrate with at least one hydrophilic colloid layer coated thereon wherein said hydrophilic colloid layer contains photosensitive silver halide grains, wherein at least 50% of said silver halide grains comprise tabular grains with an average aspect ratio of greater than 2:1; said colloid layer further contains at least one compound selected from the group comprising:

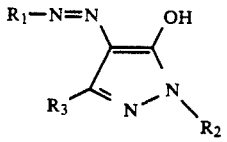

wherein R1=substituted or unsubstituted aromatic ring; R2=H, substituted or unsubstituted alkyl or substituted or unsubstituted aryl; R3=a alkyl group, a aryl group, a COOR group wherein R is hydrogen, alkyl or aryl, alkali metal cation, HNR4+ wherein R4 is alkyl, substituted alkyl or alkyaryl.

DETAILED DESCRIPTION OF THE INVENTION

A class of pyrazolone azo dyes incorporated in a silver halide emulsion according to the teachings of this invention increase the speed of the silver halide grains contained therein when exposed with ultraviolet radiation. The dye structures useful within the ambit of this invention are:

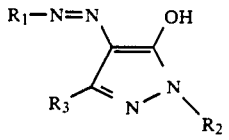

or its equilibrium equivalent:

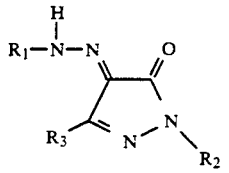

wherein R1=substituted or unsubstituted aromatic ring; R2=H, substituted alkyl, unsubstituted alkyl, substituted aryl, or unsubstituted aryl; R3=an alkyl group, an aryl group, a COOR group wherein R is hydrogen, alkyl, aryl or an alkali metal cation, HNR4+ wherein R4 is alkyl, substituted alkyl or alkyaryl. The exemplary examples provided below are known in the art as acutance dyes when employed with conventional blue or green emitting screens. When ultraviolet emitting screens are used these dyes show great utility as a sensitizer within the teachings of this invention. The exemplary examples listed below are not intended to limit the bounds of the described invention in any way:

I-1

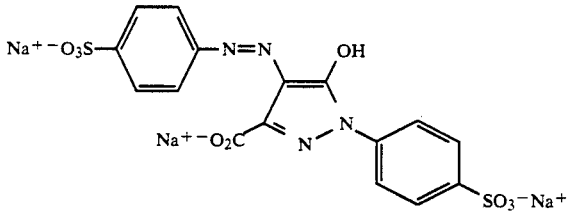

I-2

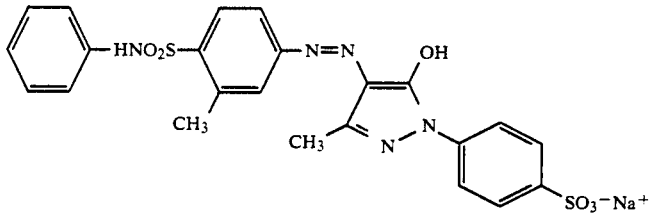

I-3

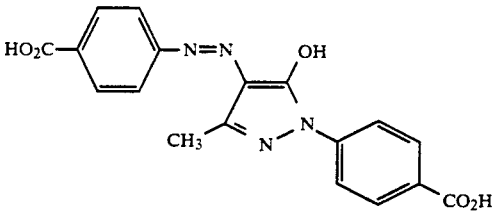

I-4

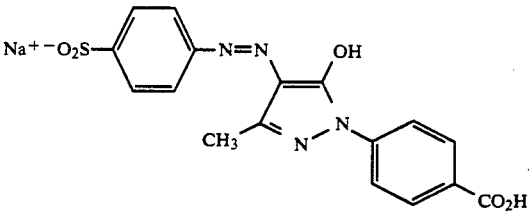

I-5

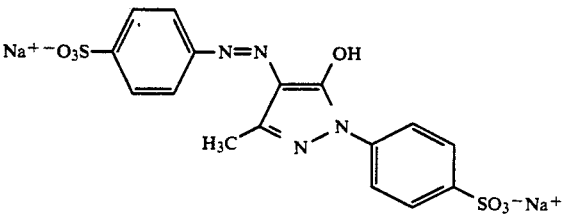

-continued

I-6

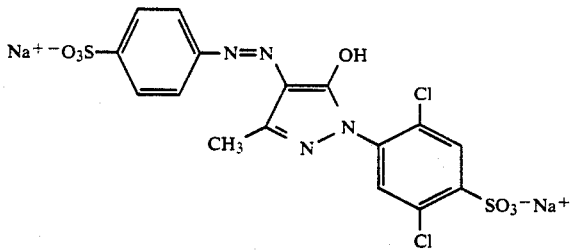

These dyes may be dissolved in any of a host of suitable solvents including water, basic water, methanol, ethanol and others as known in the art. The solutions containing these dyes are added to a photographic emulsion as known in the art in an amount in the range of 0.05 to 15 mmoles of dye per mole of silver and most preferably in an amount in the range of 0.10 to 2 mmoles of dye per mole of silver. The time and rate of addition are not important, however, we prefer addition after completion of chemical sensitization.

Representative comparative cross-over dyes which do not exhibit the unexpected increase in UV speed are:

C-1

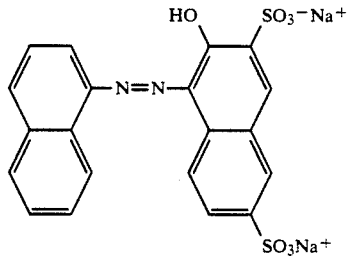

C-2

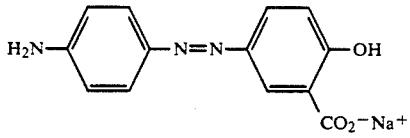

There are many well-known X-ray phosphors which emit in the ultraviolet when exposed to x-ray radiation. These phosphors are also known to produce improved image quality. However, it is also well-known that x-ray intensifying screens prepared from these UV emitting phosphors, have low contrast and depressed maximum density (Dmax) therefore causing a speed decrease and thus increased patient dosage must be employed. This dosage is deleterious to patient health and it has not been conventional in the prior art to employ these UV emitting screens with conventional medical x-ray films. Typical of these UV emitting phosphors are, for example $YTaO_4$ either alone or activated with gadolinium, bismuth, lead, cerium or mixtures of these activators; LaOBr activated with gadolinium or gadolinium and thulium; and $La_2O_2$ activated with gadolinium, among others. Most of these phosphors emit mainly in the UV (e.g. 300 to 390 nm, for example), although some small amount of visible light (e.g. up to 20% and preferably less than 10%) may also be emitted therefrom.

For the purpose of this invention, UV emitting phosphors will emit in the range of 300 to 390 nm and preferably in the range of 310 to 360 nm. For the phosphors of this invention to be applicable in practical X-ray imaging systems, the conversion efficiency of the phosphor, i.e. the efficiency with which the energy carried by an X-ray quantum is absorbed by this phosphor, and is then converted to light photons emitted by the phosphor, should be higher than 5%.

These phosphors may be prepared as is well-known in the prior art and then mixed with a suitable binder before coating on a suitable support. Once prepared in this manner, this element is conventionally known as an x-ray intensifying screen and is eminently suitable for radiological evaluations.

There are a host of commercially available X-ray intensifying phosphors that do not function within the metes and bounds of this invention. These include the following:

| Phosphor | Peak Emission (nm) | Remarks |
|---|---|---|
| Calcium Tungstate | 410 | Not a UV phosphor |
| YTaO4:Nb | 400 | Not a UV phosphor |
| Gd2O2S:Tb | 520 | Not a UV phosphor |
| YTaO4:Tm | 335 | More than 20% in the visible |
| BaFX:Eu (X = halide) | 380 | More than 20 in the visible |
| LaOBr:Tm UV | 370 & 470 | Double Peak - not a phosphor |

Conventionally, a intensifying screen comprises a support, an intensifying phosphor layer, and a topcoat or protective layer thereon. A reflective layer, such as a whitener (e.g. TiO2 dispersed in a suitable binder) may also be added into the screen structure. Commonly, this reflective layer is interposed between the phosphor layer and the support, or, alternatively, the whitener may be dispersed directly into the support. The reflective layer generally increases the light output of the intensifying screen during use. The protective layer is important to protect the phosphor layer against mechanical damage. The protective layer should generally also be UV transparent so that the flow of UV light from the phosphor is not decreased. Those layers that are known to absorb a great deal of UV light (e.g. polyethylene terephthalate films, for example) are not particularly useful within this invention. In operation, the intensifying screen absorbs x-rays that impinge thereon and emits energy having a wavelength that is readily captured by the photographic silver halide x-ray film associated therewith. Recently, an effective x-ray intensifying phosphor based on yttrium, gadolinium or lutetium tantalate has been introduced. This particular phosphor, which has the monoclinic M' phase, is particularly effective in capturing x-rays. Some of these tantalate phosphors are also efficient emitters of UV light and are particularly preferred within the metes and bounds of this invention. They are generally prepared according to the methods of Brixner, U.S. Pat. No. 4,225,653, and the information contained in this reference is incorporated herein by reference thereto. The phosphors of this invention, which cannot emit no less than 80% of their light below 300 nm or above 390 nm, are generally manufactured by mixing the various oxides and firing in a suitable flux at elevated temperatures. After firing, pulverizing and washing, the phosphor is mixed with a suitable binder in the presence of a suitable solvent therefor and coated on a support, with the proviso that said binder can absorb less than 10% of any UV light emitted from said phosphor. All of these steps are described in the aforementioned Brixner reference and all are well-known in the prior art. A protective topcoat may also be applied over this phosphor coating, in fact it is preferred.

In a particularly preferred embodiment, a x-ray intensifying screens is made by dispersing YTaO4 phosphor made as described above, in a mixture of acrylic resins using a solvent. This mixture is then coated on a polyethylene terephthalate support containing a small amount of anatase TiO2 whitener dispersed therein. The phosphor may be coated to a coating weight of ca. 15 to 100 mg of phosphor per cm2. A topcoat of styrene/acrylonitrile copolymer is coated thereon and dried.

In the radiological process, it is conventional to employ a photosensitive silver halide film element with the above described X-ray intensifying screens. In the practice of this invention, the silver halide element will be comprised of silver halide grains. These element are also well-known in the prior art and the preparation of grains are also known and taught therein. The grains are generally made into an emulsion using a binder such as gelatin, and are sensitized with gold and sulfur, for example. Other adjuvants such as antifoggants, wetting and coating aides, other sensitizing dyes, hardeners etc. may also be present if necessary. The emulsion may be double-side coated on the support and a thin, hardened gelatin overcoat is usually applied over each of the emulsion layers to provide protection thereto. Since the emulsions useful within the ambit of this invention are generally UV sensitive in and of themselves, dyes in addition to those taught herein may not be required. However, if required, a small amount of a sensitizing dye might advantageously be added. Additionally, it is also conventional to add a sensitizing dye to tabular emulsions in order to increase their ability to respond to light.

The silver halide emulsion may employ any of the conventional halides but preferred are pure silver bromide or silver bromide with small amounts of iodide incorporated therein (e.g. 98% Br and 2% I by weight for example). Any grain morphology is suitable for demonstration of these teachings including, but not limited to, grains which are formed by splash techniques and those formed by techniques involving spray techniques (i.e. single and double jet procedures). Tabular grains are most preferred.

Tabular grain silver halide products are well-known in the prior art with exemplary methods of manufacture described by Maskasky in U.S. Pat. Nos. 4,400,463; Wey, 4,399,205; Dickerson, 4,414,304; Wilgus et al., 4,434,226; Kofron et al., 4,439,520; Nottorf, 4,722,886; and Ellis, 4,801,522.

After the grains are made, it is usually preferable to disperse the grains with a binder (e.g. gelatin or other well-known binders such as polyvinyl alcohol, phthalated gelatins, etc.). In place of gelatin other natural or synthetic water-permeable organic colloid binding agents can be used as a total or partial replacement thereof. Such agents include water permeable or water-soluble polyvinyl alcohol and its derivatives, e.g., partially hydrolyzed polyvinyl acetates, polyvinyl ethers, and acetals containing a large number of extralinear —CH2HOH— groups; hydrolyzed interpolymers of vinyl acetate and unsaturated addition polymerizable compounds such as maleic anhydride, acrylic and methacrylic acid ethyl esters, and styrene. Suitable colloids of the last mentioned typed are disclosed in U.S. Pat. Nos. 2,276,322, 2,276,323 and 2,347,811. The useful polyvinyl acetals include polyvinyl acetalaldehyde acetal, polyvinyl butyraldehyde acetal and polyvinyl sodium o-sulfobinzaldehyde acetal. Other useful colloid binding agents include the poly-N-vinyllactams of Bolton U.S. Pat. No. 2,495,918, the hydrophylic copolymers of N-acrylamido alkyl betaines described in Shacklett U.S. Pat. No. 2,833,650 and hydrophilic cellulose ethers and esters. Phthalated gelatins may also be used as well as binder adjuvants useful for increasing covering power such as dextran or the modified, hydrolysed gelatins of Rakoczy, U.S. Pat. No. 3,778,278.

It is most preferable to chemically sensitize the grain with salts that are well known in the art. The most common sensitizers are salts of gold or sulfur. Sulfur sensitizers include those which contain labile sulfur, e.g. allyl isothiocyanate, allyl diethyl thiourea, phenyl isothiocyanate and sodium thiosulfate for example. Other non-optical sensitizers such as amines as taught by Staud et al., U.S. Pat. No. 1,925,508 and Chambers et al., U.S. Pat. No. 3,026,203, and metal salts as taught by Baldsiefen, U.S. Pat. No. 2,540,086 may also be used.

The emulsions can contain antifoggants, e.g. 6-nitrobenzimidazole, benzotriazole, triazaindenes, etc., as well as the usual hardeners, i.e., chrome alum, formaldehyde, dimethylol urea, mucochloric acid, and others are recited in *Research Disclosure*, No. 308, December 1989, Item 30819. Other emulsion adjuvants that may be added comprise matting agents, plasticizers, toners, optical brightening agents, surfactants, image color modifiers, non-halation dyes, and covering power adjuvants among others.

The film support for the emulsion layers used in the process may be any suitable transparent plastic. For example, the cellulosic supports, e.g. cellulose acetate, cellulose triacetate, cellulose mixed esters, etc. may be used. Polymerized vinyl compounds, e.g., copolymerized vinyl acetate and vinyl chloride, polystyrene, and polymerized acrylates may also be mentioned. Preferred films include those formed from the polyesterification product of a dicarboxylic acid and a dihydric alcohol made according to the teachings of Alles, U.S. Pat. No. 2,779,684 and the patents referred to in the specification thereof. Other suitable supports are the polyethylene terephthalate/isophthalates of British Patent 766,290 and Canadian Patent 562,672 and those obtainable by condensing terephthalic acid and dimethyl terephthalate with propylene glycol, diethylene glycol, tetramethylene glycol or cyclohexane 1,4-dimethanol (hexahydro-p-xylene alcohol). The films of Bauer et al., U.S. Pat. No. 3,052,543 may also be used. The above polyester films are particularly suitable because of their dimensional stability.

When polyethylene terephthalate is manufactured for use as a photographic support, the polymer is cast as a film, the mixed polymer subbing composition of Rawlins, U.S. Pat. No. 3,567,452 is applied and the structure is then biaxially stretched, followed by application of a gelatin subbing layer. Alternatively, antistatic layers can be incorporated as illustrated, for example, by Miller, U.S. Pat. Nos. 4,916,011 and 4,701,403, Cho, U.S. Pat. Nos. 4,891,308 and 4,585,730 and Schadt, U.S. Pat. No. 4,225,665. Upon completion of stretching and application of subbing composition, it is necessary to remove strain and tension in the base by a heat treatment comparable to the annealing of glass.

The emulsions may be coated on the supports mentioned above as a single layer or multi-layer element. For medical x-ray applications, for example, layers may be coated on both sides of the support which conventionally contains a dye to impart a blue tint thereto. Contigous to the emulsion layers it is conventional, and preferable, to apply a thin stratum of hardened gelatin supra to said emulsion to provide protection thereto.

The dyes taught herein are commercially available. Alternatively, standard synthetic procedure can be used to manufacture the compounds of the current invention. The following specific examples are provided as reference and are not intended to limit the claims in any way.

This invention will now be illustrated by the following specific example which is not intended to limit the claims in any way.

EXEMPLARY DYE SYNTHESIS EXAMPLES

Synthesis of Dye 1-3

Fifty ml of concentrated HCl was diluted with 125 ml water and mixed with 28.8 g 4-aminobenzoic acid, sodium salt. The resulting mixture was cooled to 0° C. before adding 12.5 g sodium nitrite dissolved in 25 ml water. The addition rate was controlled to maintain a reaction temperature below 5° C. The resulting slurry of precipitated diazonium salt and water was treated with urea until potassium iodide paper tested negative (no color). 4-(3-Methyl-5-oxo-2-pyrazolin-1-yl) -benzoic acid, 38.5 g, was slurried with 250 ml of water. After cooling to 0° C., 50 g sodium hydroxide in 150 ml of water was added. The resulting solution was stirred and cooled to <5° C. while adding the diazonium salt slurry dropwise. When addition of diazonium salt was complete, the ice bath was removed and the reaction mixture allowed to warm to room temperature. The mixture was acidified and the precipitated dye collected by filtration. After washing successively with dilute HCl and water, the dye was dried to yield 61.08 g, mp 327°-328° C., $\lambda_{max}=395$ ($\epsilon=28,000$), 275 ($\epsilon=23,000$).

Synthesis of Dye 1-4

Ten ml of concentrated HCl was diluted with 25 ml water and mixed with 5.19 g sulfanilic acid. The resulting mixture was cooled to 0° C. before adding 2.1 g sodium nitrite dissolved in 5 ml water. The addition rate was controlled to maintain a reaction temperature below 5° C. The resulting slurry of precipitated diazonium salt and water was treated with urea until potassium iodide paper tested negative (no color). 4-(3-Methyl-5-oxo-2-pyrazolin-1-yl)-benzoic acid, 3.78 g, was slurried with 50 ml of water. After cooling to 0° C., 10 g sodium hydroxide in 30 ml of water was added. The resulting solution was stirred and cooled to <5° C. while adding the diazonium salt slurry dropwise. When addition of diazonium salt was complete, the ice bath was removed and the reaction mixture allowed to warm and stir at room temperature for one hour. The mixture was acidified and the precipitated dye collected by filtration. After washing with acetone and drying, the yield was 6.12 g, mp 333° C., $\lambda_{max}=390$ ($\epsilon=24,000$), 275 ($\epsilon=18,000$).

EXAMPLE SCREEN A

An X-ray intensifying screen structure was made using the following procedures:

A. The Binder Solution

The following ingredients were prepared:

| Ingredient | Amount (g) |
|---|---|
| n-Butyl acetate | 43.13 |
| n-Propanol | 34.00 |
| Carboset 525 (1) | 10.00 |
| Carboset 526 (2) | 10.00 |
| Polymeric organic silicone fluid | 0.07 |
| Zelec 2457E (3) | 0.40 |
| Aerosol OT-100 (4) | 0.40 |
| Pluronic 31R1 (5) | 2.00 |

(1) Acrylic resin; ave. mol. wt. 260,000; acid no. 76-85; B. F. Goodrich Co., Cleveland, OH (2) Acrylic resin; ave. mol. wt. 200,000; acid no. 100; B.F. Goodrich Co., Cleveland OH (3) Anionic antistatic agent of mixed mono and dialkylphosphates of the general structure R2HPO4, where R is C8 to C10 alkyl; E.I. du Pont de Nemours & Co., Wilmington, DE (4) Sodium dioctyl sulfosuccinate per U.S. Pat. No. 2,441,341

(5) Ethylene oxide/propylene oxide block copolymer; ave. mol. wt. 3200; BASF Wyandotte; Wyandotte, MI

B. The X-ray Phosphor

The following ingredients were thoroughly mixed in a paint shaker for about 2 hours before charging to a alumina crucible:

| Ingredient | Amount (g) |
|---|---|
| Y2O3 | 101.46 |
| Ta2O5 | 198.54 |
| Li2SO4 | 150.00 |

The crucible was then placed in a standard, commerical, high temperature furnace and fired at about 1200° C. for about 8 hours and then at about 1250° C. for about 16 hours. The furnace was then allowed to cool and the contents of the crucible weighed and washed thoroughly with water to remove the unreacted salts and flux. This material was then added to the binder from above using about 200 g of phosphor/60 g of binder solution. This material was placed in a plastic container along with about 85 g of 3.8 in. diameter corundum balls (ca. 15 balls) and this mixture was then ball milled for about 12 to 16 hours at room temperature with a rotation speed of about 60 rpm. After this step, the ball milled suspension was filtered through a 75 mesh Nylon bag and coated onto a suitable support.

The support used was 0.010 inch thick, dimensionally stable polyethylene terephthalate film containing a small amount of a whitener (e.g., anatase TiO2) dispersed therein. This whitener will give the support some opacity to visible light (e.g. optical density of ca.>1.7). The coating weight of the phosphor dispersion placed thereon was about 100 mg of phosphor per cm2.

C. The Overcoat Layer

An overcoat layer is prepared from the following solutions:

| 1) Ingredient | Amount (g) |
|---|---|
| Acetone | 67.00 |
| Methanol | 9.00 |
| n-Butyl acetate | 4.80 |
| Tyril* 100 (1) | 12.70 |
| Carboset* XL-27 (2) | 9.00 |

(1) Styrene/acrylonitrile copolymer resin; Dow Chemical Co., Midland, MI
(2) Acrylic resin; ave. mol. wt. 30,000; acid no. 80, B.F. Goodrich Co., Cleveland, OH A gel solution is prepared by mixing the following ingredients until a thick gel forms:

| | Ingredient | Amount (g) |
|---|---|---|
| 2) | Methanol | 14.70 |
| | Triamylamine | 0.20 |
| | Carbopol* 1342 (1) | 0.132 |
| 3) | Solution 1 | 50.00 |
| | Gel Solution 2 | 12.19 |

(1) Acrylic resin thickener; B. F. Goodrich Co., Cleveland, OH This solution is filtered and a mixture is prepared as follows:

This mixture is coated on top of the phosphor coating using a doctor knife with a 0.004 in. gap. The resulting top-coat is air dried for 12–16 h at 40° C.

EXAMPLE OF PREPARATION FOR THE FILM ELEMENT E-1

A conventional, tabular grain, blue sensitive X-ray emulsion was prepared as well-known to one of normal skill in the art. This emulsion had tabular silver bromide grains. After precipitation of the grains the average aspect ratio was determined to be about 5:1 and thickness of about 0.2 um. The procedures for making tabular grains of this nature are fully described in Nottorf, U.S. Pat. No. 4,772,886 and Ellis, U.S. Pat. No. 4,801,522, the contents of which are incorporated herein by reference.

These grains were dispersed in photographic grade gelatin (about 117 grams gelatin/mole of silver bromide) and a solution of 200 mg of 5-(3-methyl-2-benzothiazolinylidene)-3-carboxymethylrhodanine sensitizing dye dissolved with 128 mg of tri-n-butylamine and 2 ml of methanol added to achieve 133 mg of dye per mole of silver halide. At this point, the emulsion was brought to its optimum sensitivity with gold and sulfur salts as is well-known to those skilled in the art. The emulsion was then stabilized by the addition of 4-hydroxy-6-methyl-1,3,3a,7-tetraazaindene and 1-phenyl-5-mercaptotetrazole. A large sample of the stock emulsion was divided into smaller samples containing 0.15 moles of silver halide. Immediately after cessation of sensitization the subject dyes were added as a water solution in the amounts indicated in the Table. Control samples were prepared in a manner identical to the inventive examples. The usual wetting agents, antifoggants, coating aides and hardeners were added and this emulsion was then coated on a dimensionally stable, 7 mil polyethylene terephthalate film support which had first been coated with a conventional resin sub followed by a thin substratum of hardened gelatin applied supra thereto. These subbing layers were present on both sides of the support. The emulsion was coated on one side of the support at a silver halide coating weight of about 2 g/m2. A thin abrasion layer of hardened gelatin was applied over each of the emulsion layers. After drying, samples of this film were used with X-ray intensifying screens as further described herein.

PREPARATION FOR THE FILM ELEMENT

A conventional blue sensitive X-ray emulsion was prepared as well-known to one of normal skill in the art. This emulsion had conventional silver bromide grains. These grains were dispersed in about 107 grams of photographic grade gelatin per mole of silver bromide. The emulsion was brought to its optimum sensitivity with gold and sulfur salts as is well-known to those skilled in the art. The emulsion was then stabilized by the addition of 4-hydroxy-6-methyl-1,3,3a,7-tetraazaindene and 1-phenyl-5-mercaptotetrazole. After cessation of sensitization the subject dyes were added as a water solution in the amounts indicated in the Table. Control samples were prepared in a manner identical to the inventive examples. The usual wetting agents, antifoggants, coating aides and hardeners were added and this emulsion was then coated on a dimensionally stable, 7 mil polyethylene terephthalate film support which had first been coated with a conventional resin sub followed by a thin substratum of hardened gelatin applied supra thereto. These subbing layers were present on both sides of the support. The emulsion was coated on one side of the support at a silver halide coating weight of about 2.5 g/m2. A thin abrasion layer of hardened gelatin was applied over each of the emulsion layers. After drying, samples of this film were used with X-ray intensifying screens as further described herein.

FILM/SCREEN EXPOSURE EXAMPLE

Screens were used to expose X-ray film elements. Screens made according to the above description were used and are represented by Screen A. Control Screen B was a standard LaOBr:Tm screen which is commercially available from DuPont (Wilmington, Del.). The screens were given an exposure to a 60 KvP X-ray source with a tungsten cathode. After exposure, the films were developed in a standard X-ray developer formulation, fixed, washed and dried as known in the art.

TABLE 1

RELATIVE PHOTOGRAPHIC SPEEDS

| EMULSION | DYE | AMOUNT OF DYE g/mole Ag | RELATIVE SPEED SCREEN A | RELATIVE SPEED SCREEN B |
|---|---|---|---|---|
| E-1 | — | 0 | 100 | 100 |
| E-1 | C-3 | 0.5 | 93 | 92 |
| E-1 | C-4 | 0.5 | 25 | 26 |
| E-1 | I-1 | 0.13 | 110 | 97 |
| E-1 | I-1 | 0.33 | 104 | 89 |
| E-1 | I-1 | 0.53 | 108 | 86 |
| E-1 | I-2 | 0.25 | 99 | 96 |
| E-1 | I-2 | 0.50 | 106 | 98 |
| E-1 | I-2 | 0.75 | 108 | 96 |
| E-1 | I-3 | 0.07 | 105 | 100 |
| E-1 | I-3 | 0.13 | 100 | 102 |
| E-1 | I-3 | 0.33 | 93 | 85 |
| E-1 | I-4 | 0.80 | 102 | 90 |
| E-1 | I-4 | 1.07 | 105 | 78 |
| E-1 | I-4 | 1.33 | 109 | — |
| E-2 | — | 0 | 100 | 100 |
| E-2 | I-1 | 0.13 | 105 | 99 |
| E-2 | I-1 | 0.27 | 103 | 94 |
| E-2 | I-1 | 0.53 | 90 | 80 |
| E-2 | I-1 | 0.67 | 87 | 79 |
| E-2 | I-1 | 0.80 | 88 | 74 |
| E-2 | I-1 | 0.93 | 88 | 71 |
| E-2 | I-3 | 0.05 | 96 | 99 |

TABLE 1-continued

| EMULSION | DYE | AMOUNT OF DYE g/mole Ag | RELATIVE PHOTOGRAPHIC SPEEDS RELATIVE SPEED SCREEN A | SCREEN B |
|---|---|---|---|---|
| E-2 | I-3 | 0.09 | 90 | 88 |
| E-2 | I-3 | 0.19 | 94 | 89 |
| E-2 | I-3 | 0.37 | 93 | 85 |
| E-2 | I-3 | 0.47 | 95 | 87 |
| E-2 | I-4 | 0.05 | 100 | 99 |
| E-2 | I-4 | 0.09 | 90 | 92 |
| E-2 | I-4 | 0.19 | 93 | 92 |
| E-2 | I-4 | 0.37 | 91 | 90 |
| E-2 | I-4 | 0.47 | 93 | 87 |

We claim as our invention:

1. A radiographic element comprising at least one x-ray intensifying screen in operative association with a photographic element;

wherein said x-ray intensifying screen comprises:

a support bearing a phosphor layer thereon; said phosphor layer comprises a binder with a phosphor dispersed therein, said phosphor further characterized by emission of light thereof wherein at least 80% of light emitted upon exposure to x-ray radiation is between 300 and 390 nm, and said binder absorbs less than 10% of any light emitted from said phosphor;

wherein said photographic element comprises:

a substrate with at least one hydrophilic colloid layer coated thereon wherein said hydrophilic colloid layer contains photosensensitive silver halide grains, wherein at least 50% of said silver halide grains comprise tabular grains with an average aspect ratio of greater than 2:1; said colloid layer further contains at least one compound selected from the group comprising:

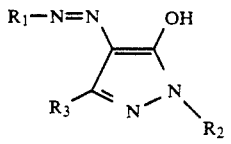

wherein R1=substituted or unsubstituted aromatic ring; R2=H, substituted or unsubstituted alkyl or substituted or unsubstituted aryl; R3=an alkyl group, an aryl group, a COOR group wherein R is hydrogen, alkyl, aryl or an alkali metal cation, HNR4+ wherein R4 is alkyl, substituted alkyl or alkyaryl.

2. A radiographic element as recited in claim 1 wherein said phosphor has a peak emission between 310 and 360 nm.

3. A radiographic element as recited in claim 1 wherein said phosphor is selected from the group comprising yttrium tantalate, yttrium tantalate activated with gadolinium, and lanthanum oxybromide activated with gadolinium.

4. A radiographic element as recited in claim 1 wherein said binder comprises an acrylic resin with an average molecular weight of about 100,000 to about 300,000.

5. A radiographic element as recited in claim 1 wherein said silver halide grain is taken from the group consisting of silver bromide, silver chloride, silver iodide or mixtures thereof.

6. a radiographic element as recited in claim 1 wherein said compound is selected from the group consisting of

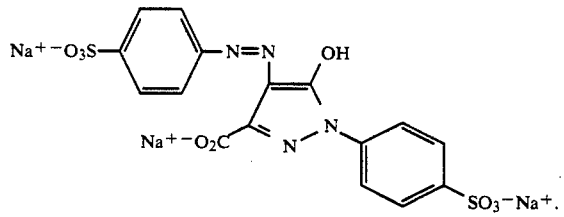

and

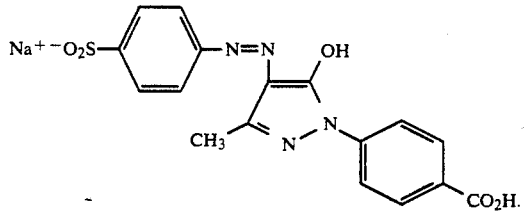

7. A radiographic element as recited in claim 1 wherein 0.05 to 15 mmoles of said compound are present per mole of silver.

8. A radiographic element as recited in claim 7 wherein 0.10 to 2 mmoles of said compound are present per mole of silver.

* * * * *